US005211123A

United States Patent [19]

Greenwood

[11] Patent Number: 5,211,123

[45] Date of Patent: May 18, 1993

[54] SAILBOARD

[76] Inventor: Marvin H. Greenwood, 3444 Wickersham, Houston, Tex. 77027

[21] Appl. No.: 766,107

[22] Filed: Sep. 27, 1991

Related U.S. Application Data

[63] Continuation-in-part of Ser. No. 627,981, Dec. 17, 1990, abandoned.

[51] Int. Cl.[5] ..... B63B 35/79

[52] U.S. Cl. ..... 114/39.2; 114/91

[58] Field of Search ..... 114/91, 98, 93, 39.2

[56] References Cited

U.S. PATENT DOCUMENTS

| | | | |
|---|---|---|---|
| Re. 31,167 | 3/1983 | Schweitzer et al. | 114/39 |
| 3,707,935 | 1/1973 | Rachie | 114/39 |
| 4,311,107 | 1/1982 | Imre | 114/39.2 |
| 4,473,022 | 9/1984 | Eastland | 114/103 |
| 4,541,355 | 9/1985 | Denton | 114/39 |
| 4,774,901 | 10/1988 | Baldwin | 114/39 |

FOREIGN PATENT DOCUMENTS

| | | | |
|---|---|---|---|
| 61-291291 | 12/1986 | Japan | 114/39.2 |

*Primary Examiner*—Sherman Basinger

[57] ABSTRACT

An improved sailboard in which the sail assembly is mounted to the board in a manner to allow pivoting about an axis inclined rearwardly and also about a horizontal pivot pin. The sail assembly is supported from a shaft secured in the board and having an axis which is inclined toward the rear of the board. A spindle is mounted by suitable bearing on the inclined shaft and the sail assembly is secured to the spindle by a horizontal pivot pin. The sail assembly includes the sail, a wishbone tiller, a mast and a boom. The boom is secured to the horizontal pivot pin and the mast is pivotally mounted to the boom with the sail supported by both. A pawl is provided to secure the mast in its operating position with respect to the boom and when released allows the mast to pivot toward the boom to collapse the sail. A collar on the spindle having a forwardly opening slot and a pin on the shaft for entering the collar slot, the function of which is to prevent boom rotation when the sail assembly is in its most aft position.

9 Claims, 4 Drawing Sheets

SAILBOARD

CROSS-REFERENCE TO RELATED APPLICATIONS

The present application is a continuation-in-part application of the inventor's prior copending application Ser. No. 07/627,981, filed Dec. 17, 1990 and now abandoned.

BACKGROUND

The present invention relates to an improved sailboard which has an improved mounting for the sail to the board that has new, improved and unique characteristics. Prior to the present invention sailboards usually included a wood or fiberglass board having a rear skeg fixed to the lower rear surface of the board, an opening through the board for a dagger board or center board and a means for mounting a mast to the board.

An early U.S. Pat. No. 3,487,800 which was reissued as Re. 31,167 on Mar. 8, 1983 discloses a surfboard having a rear mounted skeg and a dagger board extending therethrough with the dagger board having an upper platform on which the mast or spar for supporting the sail is mounted. A pair of curved booms are mounted to the mast, secure the clew of the sail and function as control handles which can be held by the rider to control the position of the sail. The mast or spar is secured to the dagger board platform by a universal joint so that it can pivot about a plurality of axes. Thus, when the mast is released it will fall into the water.

U.S. Pat. No. 3,707,935 discloses a sailboard with a mast and sail mounted near the stern of the board with the rider intended to stand on a forward portion of the board with respect to the sail. The sail is mounted for rotation with respect to the mast and includes a weighted arm which moves circumferentially on an inclined track. This causes the sail to be moved when the rider tilts the board and the movement of the sail assists in the turning of the board.

U.S. Pat. No. 4,473,022 discloses a sail which is to be used by a person on roller skates and in its modified form is shown adapted for connection with a riding board with the mast mounted for rotation with respect to the board by a universal joint and the universal joint is mounted in a receptacle in the board.

U.S. Pat. No. 4,541,355 discloses a structure in which a mast is mounted to the upper surface of a board at a point which is immediately forward of the dagger board, a fin is rotatably mounted on the mast and a boom is supported from the fin by an auxiliary boom with a bar, A pin connects the auxiliary boom to the fin. A means is provided for connecting the boom in parallel relation to the auxiliary boom and also the boom is connected to the center of gravity of the sail.

U.S. Pat. No. 4,774,901 discloses a sailboard construction which includes a quick disconnecting connection between the mast and the pivot which is secured to the board. Also, this patent discloses structure for securing the downhaul and outhaul lines to the mast. Such lines are used for tensioning the sail.

In such prior sailboards, it is common to allow the sail to drop to the water when the rider falls. This creates a problem for the rider in that after remounting the board it is necessary to lift the sail and mast to an upright position before resuming sailing on the board. In those structures in which the sail does not fall into the water there is no assurance that the board will not keep sailing away from the fallen rider.

SUMMARY

The present invention provides an improved articulated assembly for a sailboard in which the sail is supported between two spars or booms that are rotatably connected to a spindle mounted around a shaft which is secured in the board on the plane of symmetry and is slightly inclined to the rear and at a position forward of the dagger board. The spindle is pivotally mounted on the shaft to allow the assembly to pivot around the shaft. Also the assembly is pivotally connected to the spindle about an axis which is substantially horizontal so that the sail can be moved fore and aft for control in the turning of the sailboard.

An object of the present invention is to provide an improved sailboard which is of simple construction and provides smooth and efficient operation for the rider.

Another object of the present invention is to provide an improved sailboard which when left unattended will head into the wind and remain in such position until positively controlled by a rider.

Still another object of the present invention is to provide an improved sailboard which provides an improved mounting for the sail to the board.

A further object of the present invention is to provide an improved sailboard in which the movement of the sail fore and aft for turning of the sailboard is relatively simple and does not require excessive force.

Another object of the present invention is to provide an improved sailboard in which the raising of the sail does not change the lateral balance of the rider on the board.

A yet further object of the present invention is to provide an improved sailboard which when manned with the rider restraining the wishbone tiller in both azimuth and elevation, so that the mast will resist horizontal forces to permit the rider to stabilize his position on the board.

BRIEF DESCRIPTION OF THE DRAWINGS

These and other objects and advantages of the present invention are hereinafter described and explained with reference to the drawings wherein.

DESCRIPTION OF THE PREFERRED EMBODIMENT

Figure 1:
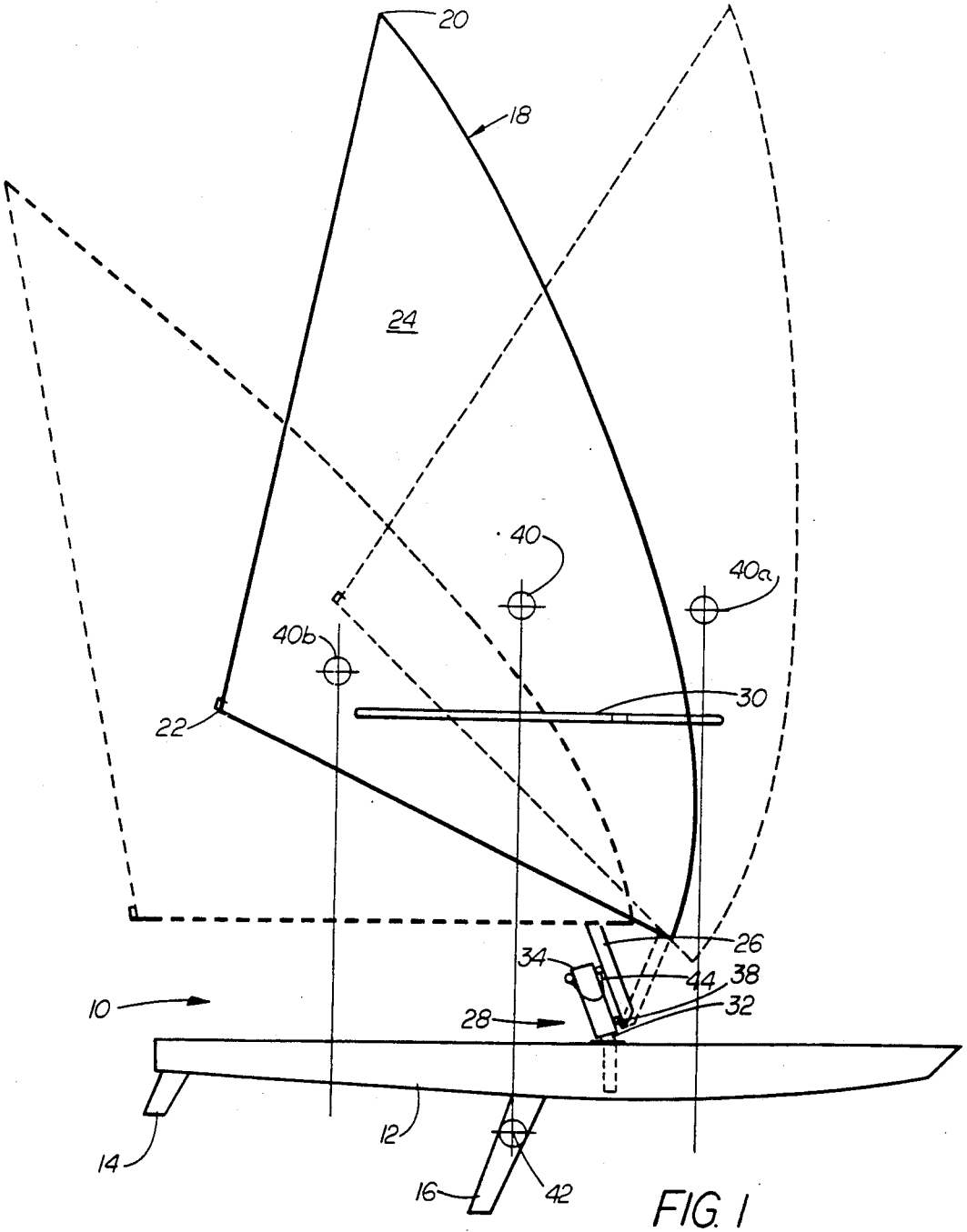
FIG. 1 is a side elevation view of the improved sailboard of the present invention. The normal or non-turning turning position of the sail is shown in solid lines and the turning positions of the sail are shown in dashed lines. The centers of effort of the three sail positions are shown with respect to the center of lateral resistance of the daggerboard.

The improved structure of the sailboard 10 of the present invention is shown generally in FIG. 1 and includes board 12 which has skeg 14 mounted to its rear lower surface, dagger board 16 which extends through an opening in board 12 and below the board 12 at approximately its midpoint and is on the plane of symmetry and the sail assembly 18 which is mounted to the board 12 as hereinafter described at a point on the plane of symmetry and positioned forward of the dagger board 16. In order to properly control sailboard 10, sail assembly 18 is pivotally mounted with respect to an axis which is inclined to the rear and on the plane of symmetry of board 12 and also about a horizontal axis which is near the upper surface of board 12 and near the inclined pivotal axis of said assembly 18.

Sail assembly 18 includes mast 20 and boom 22 which are pivotally connected to each other and to support sail 24 as shown. Additionally, assembly 18 includes a shaft 26 extending from boom 22 which is suitably connected to board 12 by sail assembly mounting means 28 as hereinafter described. Suitable operating means, such as wishbone tiller 30 is pivotally connected to mast 20 at a convenient level for the rider and to allow convenient storage of tiller 30 when the mast 20, boom 22 and sail 24 are collapsed for storage. Wishbone tiller 30 is used by the rider to control the angle of the sail 24 with respect to the wind to control the speed of the sailboard 12 and the angle of mast 20 with respect to board 12 to control the turning of sailboard 12.

Figure 2:
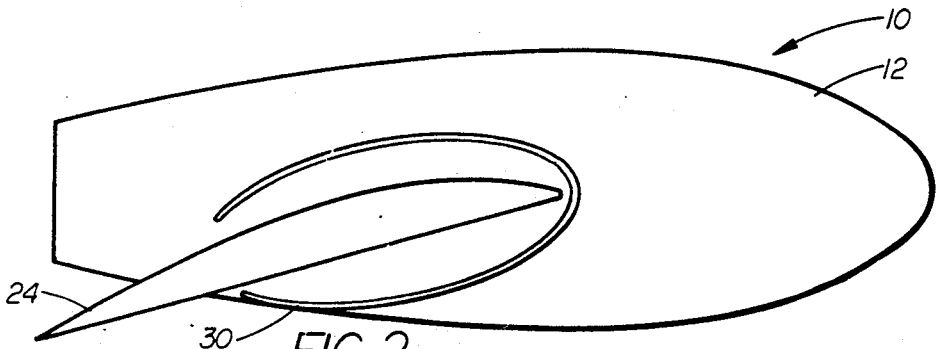
FIG. 2 is a plan view of the improved sailboard shown in FIG. 1.
Figure 3:
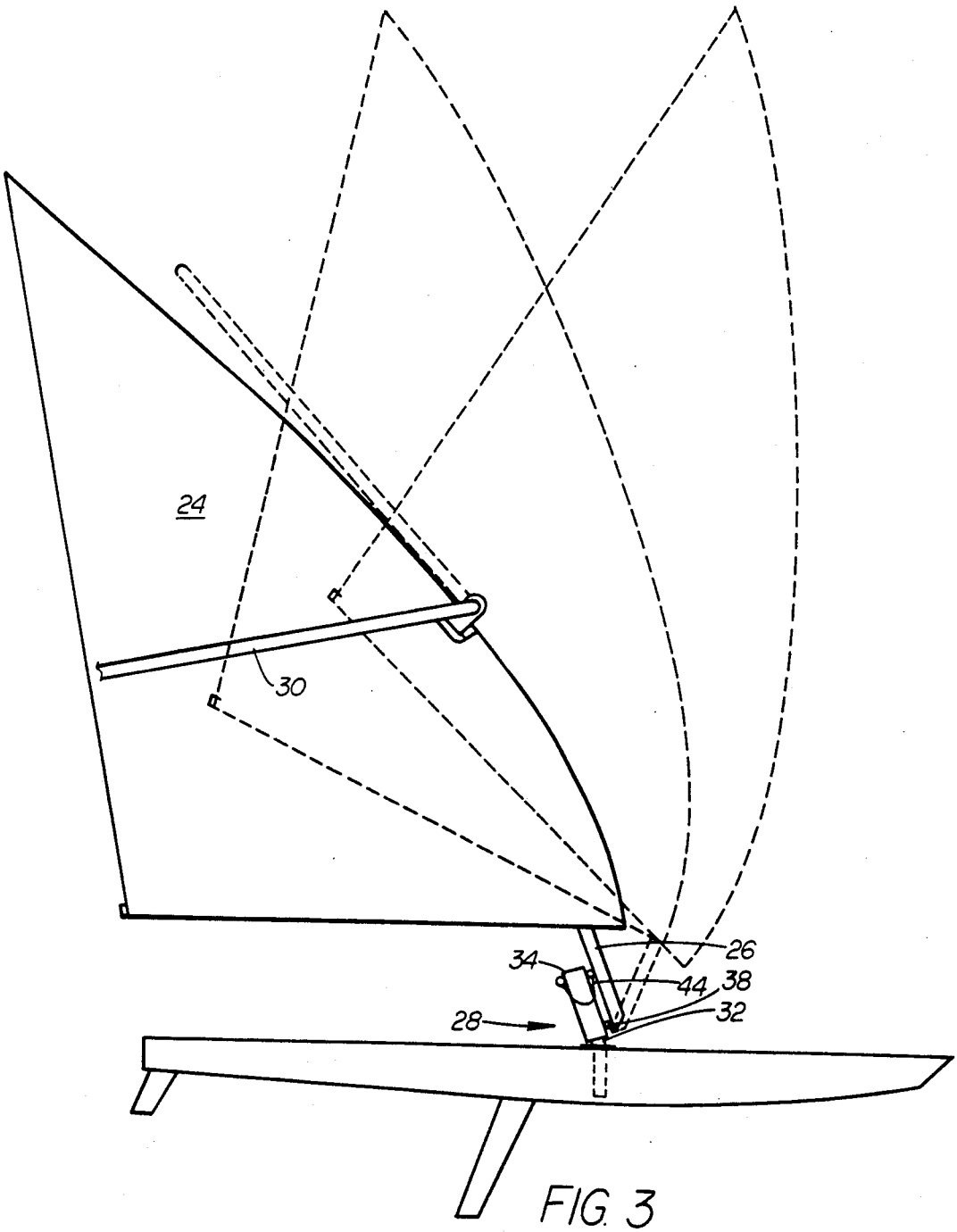
FIG. 3 is a detail elevation view of the sailboard with the sail in its open position, ready for sailing and illustrating the support for the sail assembly with respect to the board.
Figure 4:
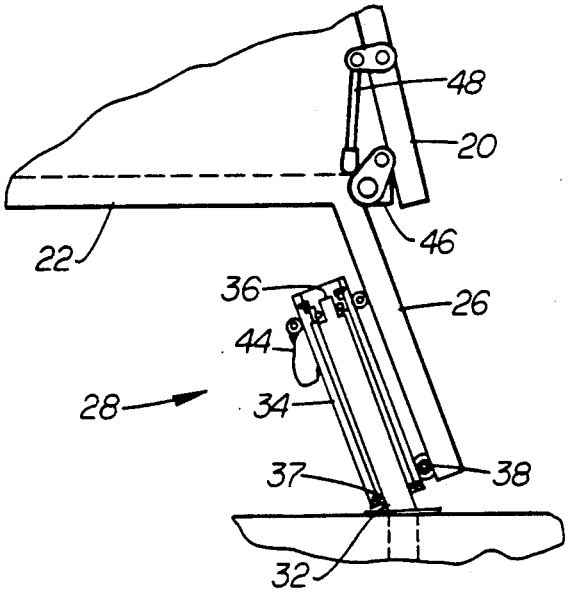
FIG. 4 is a detail sectional view of the sail assembly mounting to the sailboard with the sail in its running position.

Sail assembly mounting means 28, as best seen in FIGS. 3 and 4, includes shaft 32 which is securely mounted in board 12 on its plane of symmetry, extends above the upper surface of board 12 and is inclined to the rear as shown. Spindle 34 is mounted around shaft 32 by suitable bearings 36 so that it will rotate about the inclined axis of shaft 32. Locking ring 37 (which may be a split ring for ease of assembly) is positioned between shaft 32 and spindle 34 to secure spindle thereon. Horizontal pivot pin 38 is secured to the exterior of spindle 34 and is generally horizontal or parallel to the upper surface of board 12 when pin 38 is positioned forward of shaft 32. Shaft 26 is engaged by pin 38 so that sail assembly 18 can be pivoted thereabout to cause sail 24 to be moved forward and aft of its non-turning position shown in solid lines in FIG. 2. As can be seen from FIG. 1, the center of effort 40 of sail 24 is substantially aligned vertically with the center of lateral resistance 42. When sail assembly 18 is moved forward, its center of effort 40A is moved forward of the center of lateral resistance 42 which will cause the forward portion of board 12 to turn downwind and when sail assembly 18 is moved rearward, its center of effort 40B is moved rearward of the center of lateral resistance 42 which will cause the forward portion of board 12 to turn upwind. Cable 44 is secured to spindle 34 and to shaft 26 to limit the amount of forward pivoting of sail assembly 18.

Figure 5:
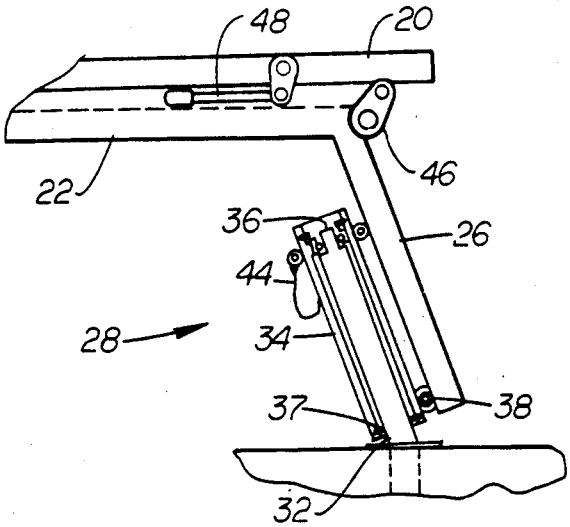
FIG. 5 is a detail sectional view similar to FIG. 4 but illustrating the sail assembly in its doused position.

Sail assembly 18 is collapsible in that shaft 26 is integral with boom 22 and mast 20 is pivotally connected to boom 22 by linkage 46. Friction pawl 48 is pivotally supported from the inner portion of mast 20 and is adapted to engage the upper surface of boom 22 to maintain sail assembly in its sailing or expanded position. When it is desired to collapse or douse sail assembly 18 it is only necessary to pivot friction pawl 48 out of engagement with the upper surface of boom 22 and to pivot wishbone tiller 30 to a position generally parallel with mast 20. This position is shown in FIG. 5.

In operation, the improved sailboard 10 of the present invention when not controlled by a rider will sail into a position headed into the wind as hereinafter explained. With no one controlling sail assembly 18 moves to its rearward position with the center of sail effort being below or to the rear of the axis of shaft 32 so that sailboard 10 will weathercock into the wind. This allows the rider to swim a short distance to sailboard 10 and gain his position thereon. He does not have to raise sail assembly 18 from the water but may directly proceed to turn sailboard 10 in the direction he wants to sail by manipulation of the sail assembly 18.

As is usual the pivoting of sail assembly 18 about the axis of shaft 26 is used by the rider to position sail 24 in the best position with respect to the wind and the course to be traveled and the pivoting of sail assembly 18 about horizontal pin 38 controls the direction in which sailboard 10 is headed as has been explained.

With the improved sailboard of the present invention the advantages and objects set forth above have been achieved. The structure is simple and provides smooth and efficient operation for the rider. When left unattended the sailboard of the present invention will head into the wind and remain in such position until a rider assumes control. The sailboard is easily mounted and the sail raised without the usual balance problems for the rider. It is relatively simple to turn and the rider can readily stabilize his position on the board at all times.

Figures 6, 6A:
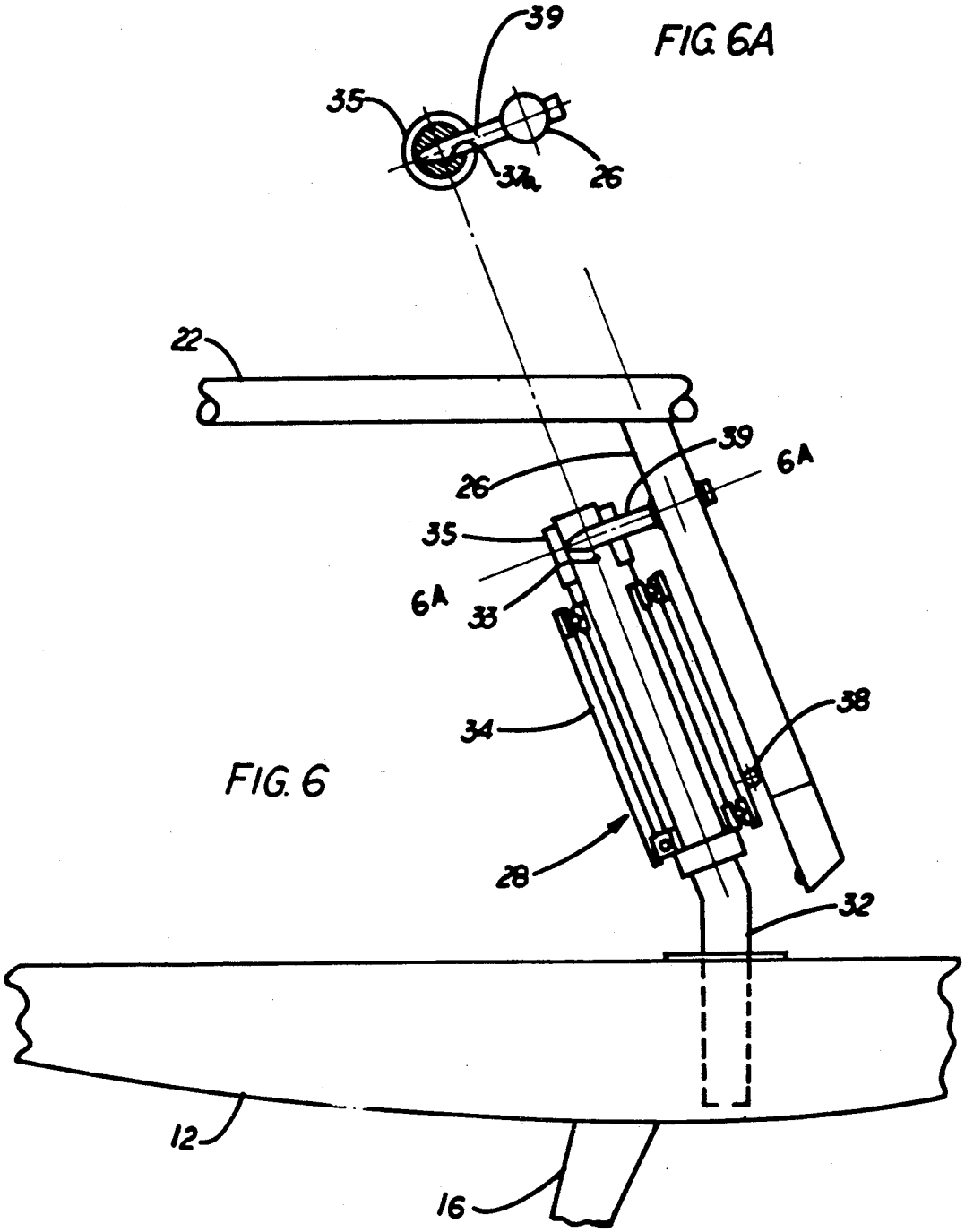
FIG. 6 is a partial elevation view of the improved sailboard of the present invention illustrating the lock for the sail when it is in its most aft position.
FIG. 6A is a view taken in FIG. 6 along line 6A—6A to more clearly illustrate the details of the lock.

FIGS. 6 and 6A illustrate an additional feature of the present invention which provides a slot into which a pin attached to the mast will fall when the sailboard is unmanned so that it will not move from the aft position and also will not rotate until it is positively moved out of the slot by pivoting the mast forward.

In the structure illustrated in FIGS. 6 AND **6*a*, shaft 32 has been extended to extend above spindle 34 and has collar 35 suitably secured thereto by pin 33 which is secured around the upper end of shaft 32. Collar 35 and shaft 32 includes slot 37*a* therein which is suitable to receive pin 39 therein as shown in FIG. 6A. The end of pin 39 is tapered to allow pin 39 to move into slot 37*a* readily. With this configuration, the mast will be rigidly connected to the sailboard as long as forward movement of the mast is prevented. With such an arrangement the force of gravity rigidly connects the boom and mast to the sailboard. When the sailboard is unmanned, the mast will fall into is most aft position, which allows pin 39 to engage slot 37*a*** and this causes the sailboard to turn into the wind and stop. This makes it easy for the rider to return to his sailboard and again control it once he has regained his position thereon.

What is claimed is:

1. A sailboard comprising a floating board structure having an upper surface, a lower surface, a rear skeg secured to extend below the rear of the lower surface and a first opening for receiving a dagger board and a second opening for receiving a shaft, a dagger board mounted in said first opening, a shaft secured in said second opening and having a rearward inclination above the upper surface of the board structure, a spindle positioned around the portion of said shaft extending above said upper surface of the: board structure, said spindle having an axis of rotation, bearing means positioned between said shaft and said spindle to allow ease of rotation of said spindle with respect to said shaft, a pivot pin horizontally mounted to said spindle, a sail assembly including a boom, a mast and a sail supported between said boom and mast, said sail assembly mounted to said horizontal pivot pin to allow pivoting of said assembly with respect to said spindle between a forward position and a rearward position, a wishbone silled secured to said sail assembly to allow a board rider to control the position of said assembly with respect to said board structure, and means limiting the amount of pivotal movement of said assembly about said horizontal pin with respect to said spindle.

2. A sailboard according to claim 1 including means for pivotally mounting said mast to said boom, means for retaining said mast in its position supporting said sail in wind catching position between said mast and said boom.

3. A sailboard according to claim 2 wherein said pivotal mounting means between said mast and said boom includes a linkage secured between said boom and said mast.

4. A sailboard according to claim 2 wherein said retaining means includes a friction pawl being pivotally mounted to said mast at one end of said pawl and having an opposite end for frictionally engaging said boom to retain said boom and mast in the desired sail supporting position.

5. A sailboard according to claim 1 wherein said pivotal movement limiting means includes a cable secured to said spindle at one end and to said sail assembly at its other end.

6. A sailboard according to claim 1 wherein the center of effort of said sail in its rearward position lies to the rear of the axis of said spindle so that said sailboard will weathercock into the wind whenever the rider is not on the board controlling the position of the sail assembly.

7. A sailboard according to claim 1 wherein said wishbone tiller is pivotally secured to said sail assembly to allow it to be pivoted into parallel position to the mast when it is stowed parallel to the boom.

8. A sailboard according to claim 1 including means supported on said shaft above said spindle for securing the sail in its rearward position when it is unattended.

9. A sailboard according to claim 8 wherein said securing means includes a collar secured to the upper end of said shaft above said spindle and having a forwardly opening slot for receiving a pin secured to said sail assembly therein when said sail assembly is in the rearward position.

* * * * *